United States Patent [19]

Sarian et al.

[11] Patent Number: 5,033,976

[45] Date of Patent: Jul. 23, 1991

[54] HINGED ELECTRICAL CONNECTOR

[75] Inventors: Grigor Sarian, Los Angeles; James K. Bullock, Burbank, both of Calif.

[73] Assignee: Baxter International Inc., Deerfield, Ill.

[21] Appl. No.: 562,173

[22] Filed: Aug. 3, 1990

[51] Int. Cl.[5] ..... H01R 13/58

[52] U.S. Cl. ..... 439/467

[58] Field of Search ..... 439/467, 465, 466, 596, 439/595

[56] References Cited

U.S. PATENT DOCUMENTS

| | | | |
|---|---|---|---|
| 2,128,883 | 8/1938 | Burt | 439/465 |
| 3,336,565 | 8/1967 | Crimmins | 439/467 |
| 3,654,592 | 4/1972 | Primorac | 439/746 |
| 3,697,926 | 10/1972 | Krafthefer | 439/746 |
| 4,311,355 | 1/1982 | Plyler et al. | 439/595 |
| 4,750,893 | 6/1988 | Sueyoshi et al. | 439/596 |
| 4,913,665 | 4/1990 | Sacksen | 439/680 |

*Primary Examiner*—Gary F. Paumen

*Attorney, Agent, or Firm*—Kay H. Pierce; Paul C. Flattery

[57] ABSTRACT

An insulated housing is described which includes a means for holding a pair of electrical connectors in parallel. The housing includes a griping means which allows a person to either insert or remove the housing from a mating electrical connection. The housing also includes a "living hinge" which, when closed, clamps on to the pair of electrical connectors to provide strain relief.

1 Claim, 4 Drawing Sheets

FIG. 3
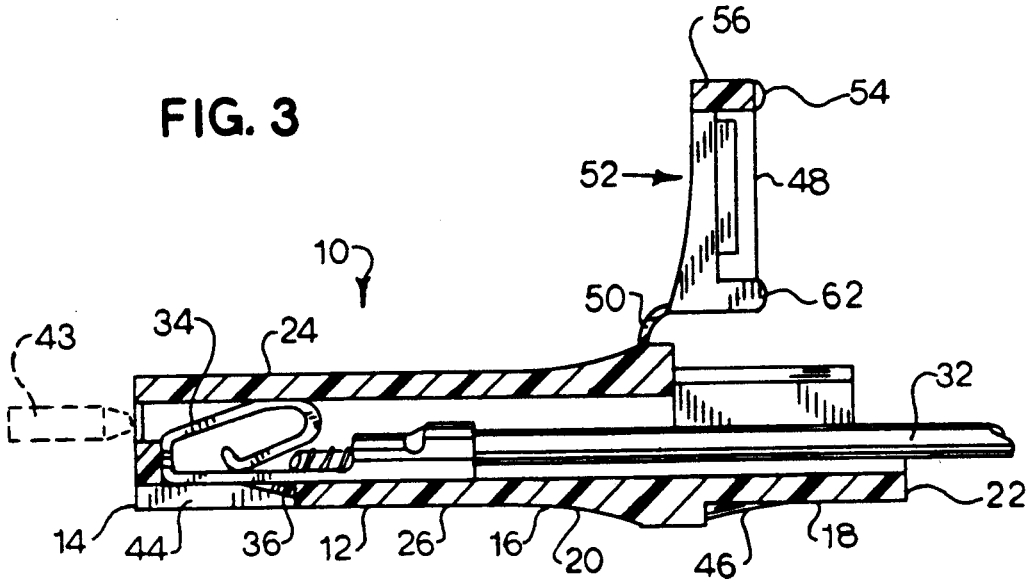
FIG. 4
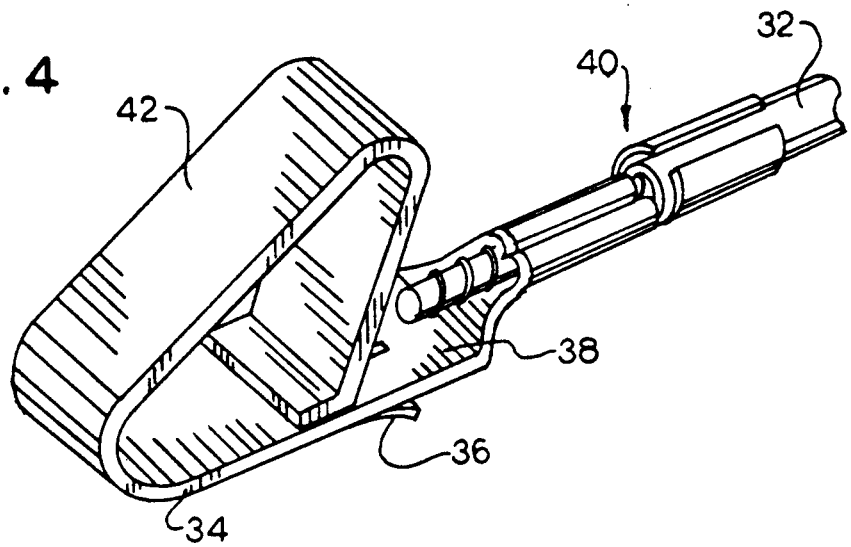
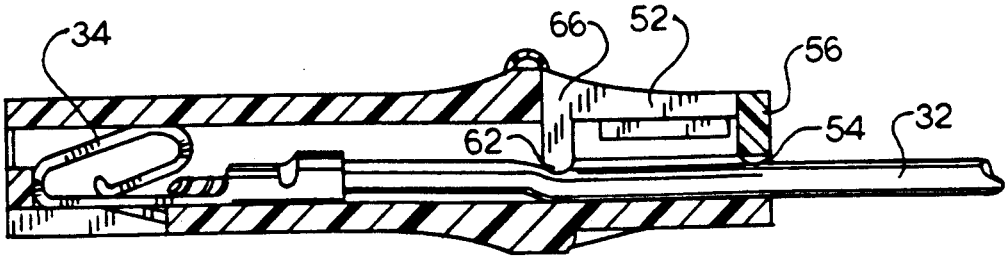
FIG. 5

FIG. 7
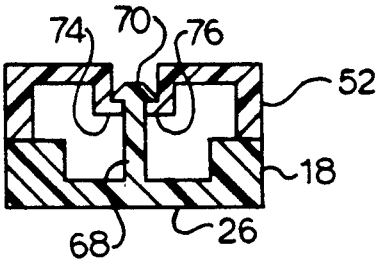
FIG. 12
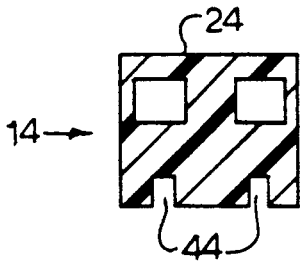
FIG. 10
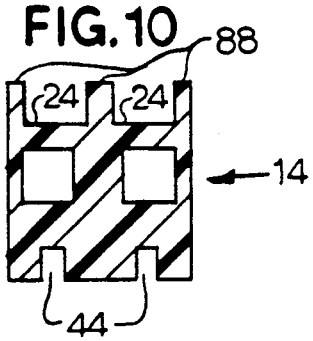
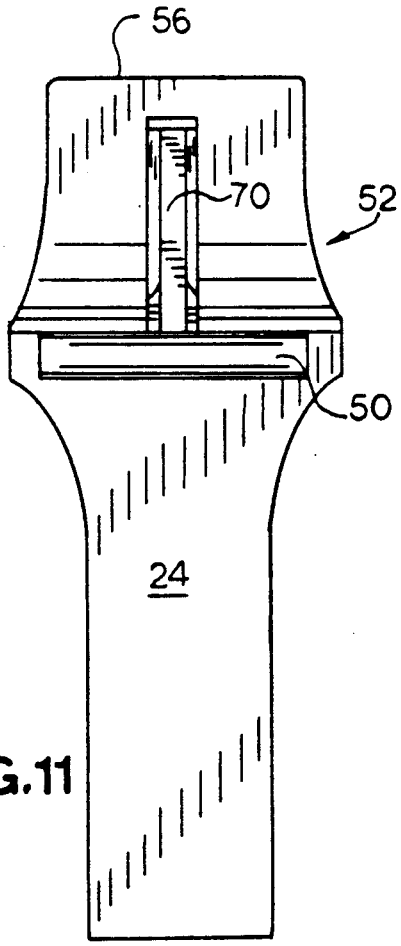
FIG. 11
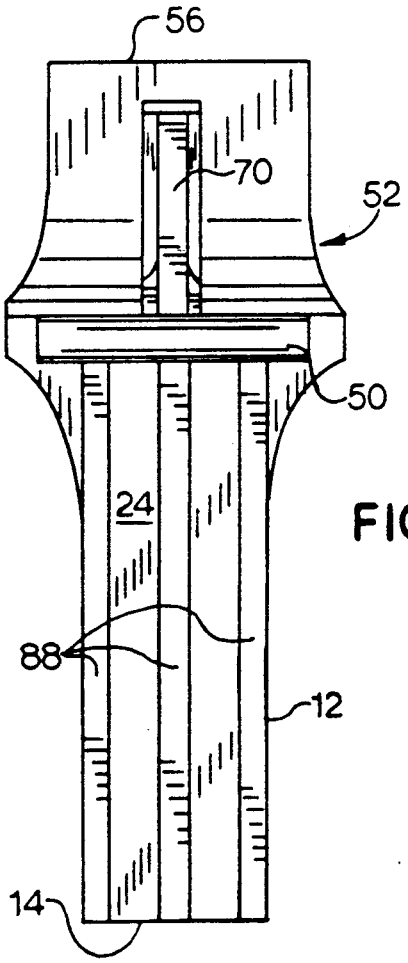
FIG. 9

HINGED ELECTRICAL CONNECTOR

FIELD OF THE INVENTION

The invention relates generally to electrical connectors and more specifically to connectors for female electrical connectors for removable insertion in a mating connector.

BACKGROUND OF THE INVENTION

Electrical connectors have been commonly used in the past. One form of connector typically used is a male/female connector in which both connectors are encased in a housing. For instance, in the field of heating circuits for respiratory therapy devices, it is frequently desirable to use a female electrical connector that is encased in an insulated housing. The corresponding male connector is also encased in an insulated housing such that the housing of the female connector can be inserted into the male connector housing. In a currently used male/female connector system for heated electrical circuits, as illustrated in FIG. 1., the female connector housing essentially fits completely within the male connector housing.

One problem with such a system is that it is very difficult for a technician to disengage the female electrical connector housing from the male connector housing because there is nothing for the technician to grasp to remove the housing other than insulated wires extending from the housing. If a technician pulls on the insulated wires to disengage the female housing, several undesirable problems may occur. For instance, the tension created by pulling the wires may cause the wires to disconnect from electrical terminals located on the end of each wire within the housing. It is possible that such disconnection may produce undesirable arcing.

Therefore, a need existed to develop a male/female electrical housing connector system which allowed an operator to easily grasp the inner housing to disengage it from an outer housing. A need also existed to develop an inner housing which provided strain relief on wires extending through the housing to reduce the possibility of electrical disconnection or arcing if the wires are subjected to stress.

Additionally, a need existed to develop an inner housing which completely prevented the possibility of a technician from contacting the electrical terminals at the end of an insulated wire.

These and other needs have been met through the development of the invention described below.

SUMMARY OF THE INVENTION

The invention can be briefly described as a housing for containing a pair of electrical connectors. Each connector has a metallic terminal having a prong extending therefrom, each terminal being attached to an insulated wire. The housing includes a first portion for maintaining the pair of electrical terminals in parallel. The first portion has a distal end that includes a pair of slits to retain each of the prongs. Each of the terminals is totally enclosed within the distal end of the first portion. The housing also includes a second portion that extends homogeneously from the proximal end of the first portion. Insulated wires extend from a distal to a proximal end of the second portion. The second portion includes a grasping means for inserting and removing the first portion from a mating connector housing. The second portion further includes a hinge means for securing each insulated wire.

BRIEF DESCRIPTION OF THE DRAWINGS

FIG. 3 is a sectional view of the housing illustrated in FIG. 2 taken along the lines 3—3;

FIG. 4 is a perspective view of a metallic electrical connector used inside the housing of the subject invention;

FIG. 5 is a sectional view of the housing of the subject invention when its flap is in the closed position;

FIG. 6(*a*) is a cross-sectional view of the flap taken along the lines a—a in FIG. 6(*a*);

FIG. 7 is a cross-sectional view of the flap in the closed position;

FIG. 9 is a top view of the housing illustrating one embodiment of the subject invention which includes stabilizing ribs;

FIG. 10 is a cross-sectional view of one embodiment of the invention, as illustrated in FIG. 10;

FIG. 11 is a top view of another embodiment of the invention; and

FIG. 12 is a cross-sectional view of the embodiment of the invention as illustrated in FIG. 11.

DETAILED DESCRIPTION OF THE PREFERRED EMBODIMENT

Figure 2:
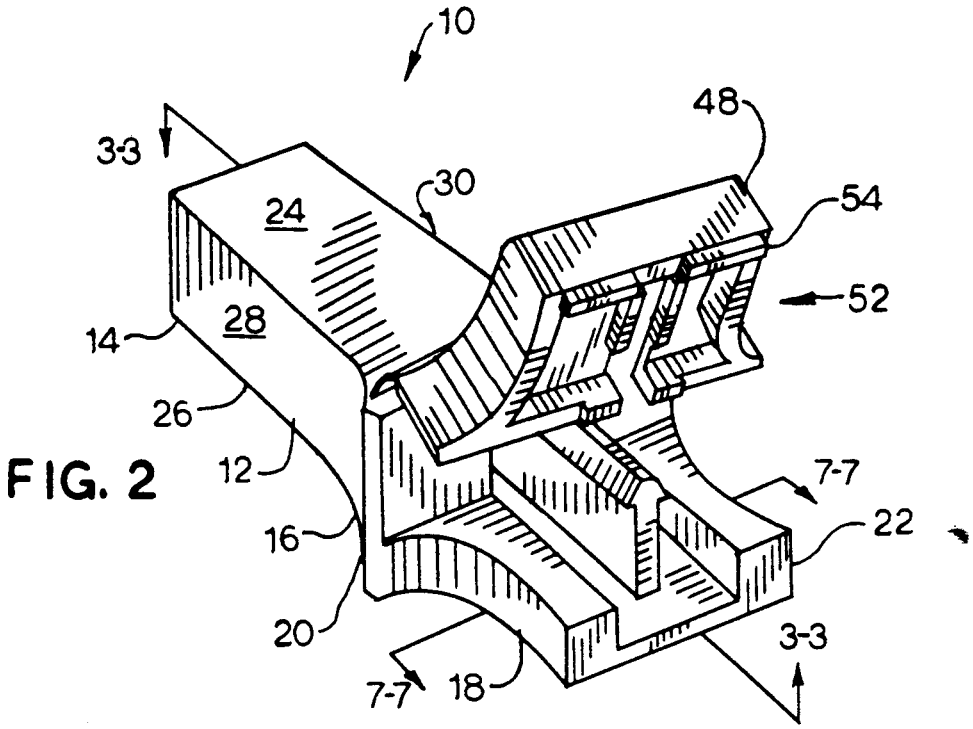
FIG. 2 is a perspective view of one embodiment of the subject invention.
Figure 1:
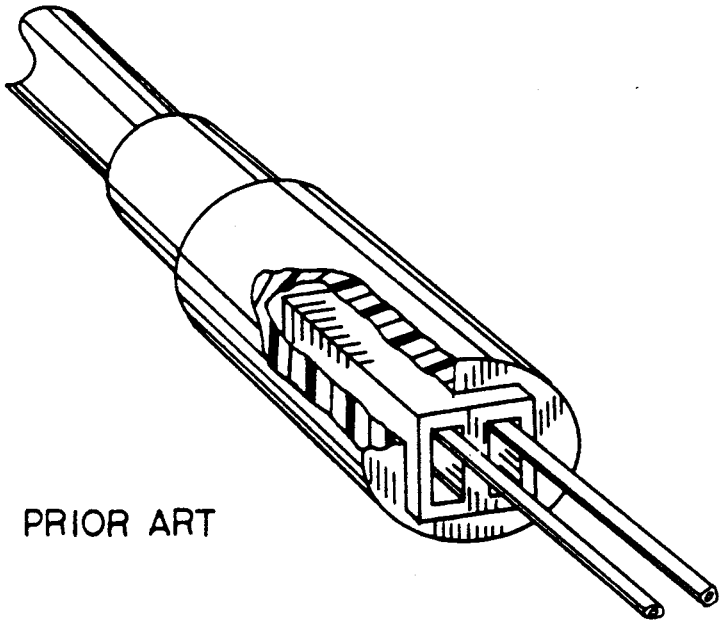
PRIOR ART FIG. 1
FIG. 1 illustrates a male/female connector system commonly used in the prior art.

Referring now to FIG. 2, a housing 10 made of a single piece of material is provided. The housing 10 includes a first portion 12 having a distal end 14 and a proximal end 16. The housing also has a second portion 18 that also includes distal and proximal ends 20, 22. The first and second portions are homogeneously connected to one another. The housing includes an upper wall 24 and a lower wall 26. Side walls 28 and 30 connect the upper and lower walls to one another.

As can be seen in FIG. 2, the housing 10 is generally rectangular in shape. Referring now to FIG. 3, which is a sectional view taken along the lines 3—3 in FIG. 2, an insulated wire 32 extends through the housing from the proximal end 22 to the first portion 12 of the housing. A metallic electrical connector 34 is attached to the insulated wire 32 inside the distal end 14 of the first portion 12. The electrical connector 34 is illustrated in greater detail in FIG. 4. As can be seen in the figure, the electrical connector includes a prong 36 which extends outwardly from the main portion 38 of the electrical connector. The proximal end 40 of the electrical connector is crimped around the insulated wire 32. The metallic electrical connector 34 includes a sloped portion 42 which serves as a female contact when a male contact 43 is inserted in the housing 10.

Returning now to FIG. 3, the prong 36 of the electrical contact extends downwardly through a slit 44 and the first portion 12 of the housing 10 when the electrical connector is inserted into the housing. The prong 36 and slit 44 served to maintain the electrical connector 34 in place within the housing 10. However, as discussed above, if the insulated wire 32 is subjected to significant tension or strain, it is possible that the insulated wire may become disconnected from the electrical connector 34. Therefore, a strain relief mechanism, which is discussed in greater detail below, has been developed as part of the subject invention.

The second portion 18 of the housing 10 includes a lower portion 46 having a distal end 20 that is homogeneously connected to the proximal end 16 of the first portion 12. The second portion 18 also includes an upper portion 48. A hinge 50 commonly known as a "living" hinge connects a flap 52 of the upper portion 48 to the first portion 12 of the housing. The hinge 50 extends homogeneously across the second portion 18 of the housing 10 at a location between the distal and proximal ends 20, 22. The living hinge 50 is formed by using a relatively thin wall of material. In the preferred embodiment of the invention, the housing is formed of a rigid insulating material. Many materials may be used to form the housing. For example, the housing may be formed of capron nylon. Any other material may be used provided that it has the following characteristics: it must be rigid, yet allow for flexibility at the hinge portion; and it must also be electrically insulating.

Referring again to FIG. 3, the upper portion 48 includes flap 52 which extends from the hinge to form the upper part of the proximal end 22 of the second portion 18. The flap 52 is movable from a first, open position to a second, closed position as illustrated in FIG. 5. The flap 52 includes a first pair of strain relief pressure points 54 at a proximal end 56 of the flap. (Only one pressure point is shown in FIG. 5 due to the cross-sectional nature of the drawing.) Both pressure points 58, 60 can be more clearly seen in FIG. 6 which is a proximal end view of the housing when the flap is in the open position. The flap 52 further includes a second pair of pressure points 62, 64 at the distal end 66. When the flap is in the closed position as illustrated in FIG. 5, each pair of pressure points act as strain relief mechanisms on the insulated wire 32. Accordingly, each insulated wire has strain relief at two separate locations along the wire immediately adjacent to the connection of the insulated wire 32 to the metallic electrical terminal 34.

Figure 6:
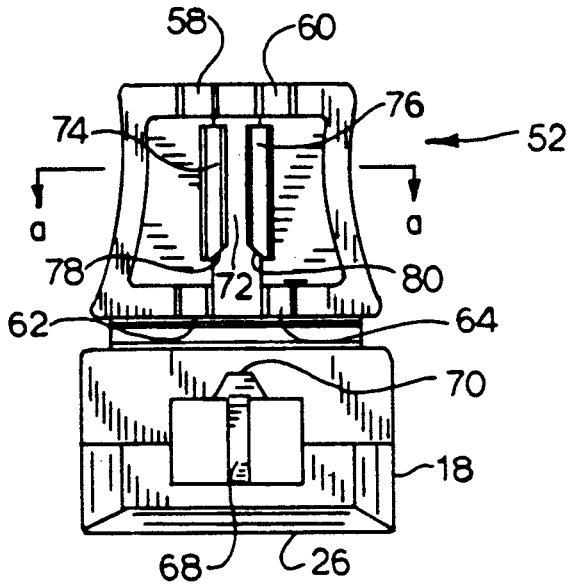
FIG. 6 is a proximal end view of the housing of the subject invention when its flap is in the open position.
Figure 6A:
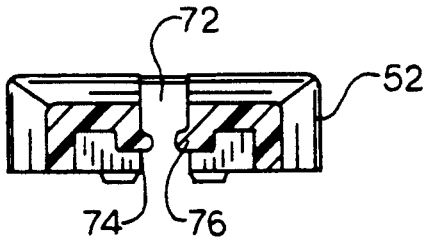

In the preferred embodiment of the subject invention as illustrated in FIG. 6, the second portion includes a locking means for locking the flap in the second closed position. The locking means includes a locking wall 68 which extends generally upwardly from the lower wall 26 of the second portion 18 of the housing 10. The locking wall 68 generally extends from the distal to the proximal end of the second portion 18 of the housing. The wall includes an arrow-shaped upper portion 70 when viewed cross-sectionally as illustrated in FIG. 6. The locking means further includes a locking slit 72 which is generally centrally located in flap 52 and generally extends from the distal to the proximal ends 66, 56 of the flap. A cross-sectional view of the flap 52 is illustrated in FIG. 7. As seen in FIG. 7, the locking slit 72 includes a pair of generally L-shaped ledges 74,76 which extend downwardly along each side of the slit. Each ledge includes an angular opening 78,80. The purpose of the angular opening is to allow each ledge 74,76 to easily slide under the arrow-shaped portion 70 of the locking wall 68 to lock the flap 52 in the closed position. If the angular openings are not provided, the flap 52 may occasionally crack when closed.

Figure 8:
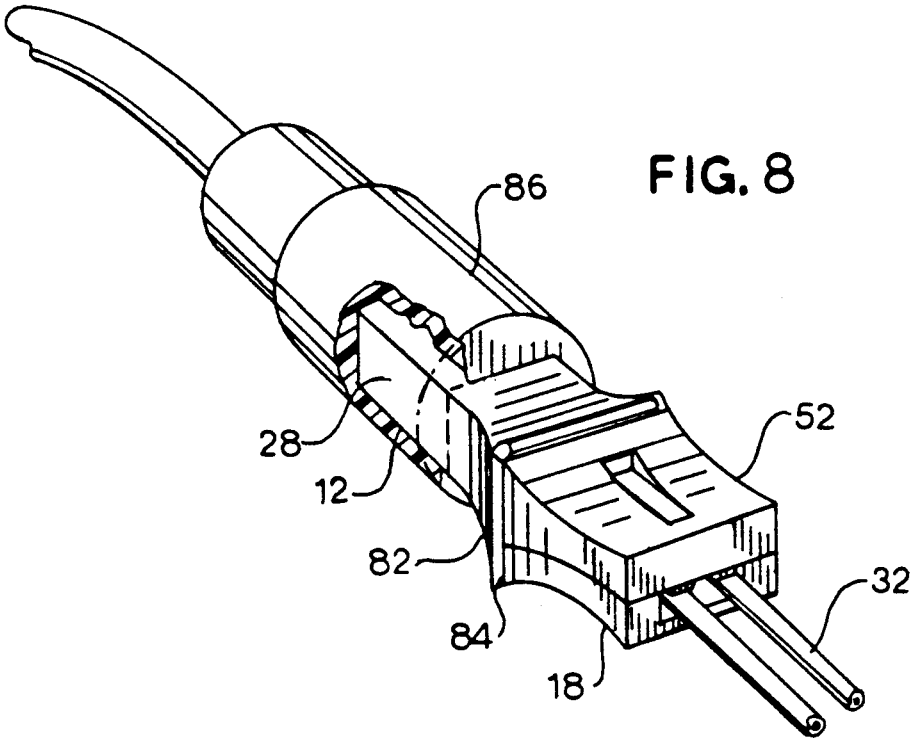
FIG. 8 is a perspective view of one embodiment of the subject invention when the flap is in the closed position.

As can be seen more clearly in FIG. 8, which is a perspective view of one embodiment of the subject invention when the flap is in the closed position, the housing 10 includes a grasping means 82. In the preferred embodiment, the grasping means 82 includes a widened section 84 that extends generally circumferentially about the housing 10 generally at the junction of the first and second portions 12,18. In one embodiment of the invention, the widened section includes a generally V-shaped portion which extends outwardly from each of the side walls 28,30 of the housing 10. This allows a person to easily grasp the housing to insert or remove the first portion 12 of the housing 10 from a mating connector housing 86. Since the metallic electrical terminals 34 are completely encased within the housing 10, and since the strain relief pressure points prevent the insulated wire 32 from being disengaged from the terminals 34, a operator can easily remove the housing 10 without inadvertently inducing arcing or contacting the terminals.

Referring now to FIGS. 9 and 10, in one embodiment of the invention, one or more ribs 88 are provided which extend along the upper wall 24 from the distal to the proximal ends 14,16 of the first portion 12 of the housing 10. The purpose of the ribs 88 is to provide stability to the housing 10 when the opening of the mating connector 86 is generally larger than the cross-section of the second portion 12 of the housing 10. The ribs act to prevent the housing 10 from "rocking" inside the mating connector section 86. In general, many other outer shapes of the first portion 12 of the housing may be provided. The goal in designing the outer shape of the first portion 12 is to allow the housing 10 to fit securely within the opening of mating connector portion 86. It should be also noted that in the preferred embodiment, the connector with ribs uses high-current heated wires, while the one without ribs uses low-current heated wires. The ribs prevent to insert high current probe into low current male connector.

I claim:

1. A insulated housing for maintaining a pair of electrical connectors in parallel, each connector having a conductive terminal attached to an insulated wire, the housing comprising:

a first portion for maintaining said pair of terminals in parallel, each of said terminals being totally enclosed within said distal end of said first portion;

a second portion extending homogeneously from a proximal end of said first portion, said insulated wires extending from a distal to a proximal end of said second portion, said second portion including a grasping means for inserting and removing first portion from a mating connector housing, said second portion further including a hinge means for securing each insulated wire, said hinge means being a living hinge;

said second portion further comprising a lower portion having a distal end homogeneously connected to the proximal end of said first portion;

an upper portion having a flap extending from said hinge and forming an upper part of a proximal end of said second portion, said flap being movable from a first, open position to a second, closed position, said flap contacting said lower portion and applying pressure to said insulated wire to provide strain relief for said wire, said strain relief including a first pair of pressure points at a proximal end of said flap and a second pair of strain relief pressure points at a distal end of said flap wherein when said flap is in said closed position, said first and second pressure points contact each of said insulated wires to provide strain relief at two locations on each of said insulated wires.

* * * * *